US012449221B2

(12) United States Patent
Malina

(10) Patent No.: US 12,449,221 B2
(45) Date of Patent: Oct. 21, 2025

(54) ASSEMBLY OF A RECEIVER WITH A BARREL

(71) Applicant: CESKA ZBROJOVKA A.S., Uhersky Brod (CZ)

(72) Inventor: Jaroslav Malina, Uherske Hradiste (CZ)

(73) Assignee: CESKA ZBROJOVKA A.S., Uhersky Brod (CZ)

( * ) Notice: Subject to any disclaimer, the term of this patent is extended or adjusted under 35 U.S.C. 154(b) by 0 days.

(21) Appl. No.: 18/858,823

(22) PCT Filed: Apr. 20, 2023

(86) PCT No.: PCT/CZ2023/000016
§ 371 (c)(1),
(2) Date: Oct. 22, 2024

(87) PCT Pub. No.: WO2023/222145
PCT Pub. Date: Nov. 23, 2023

(65) Prior Publication Data

US 2025/0277644 A1 Sep. 4, 2025

(30) Foreign Application Priority Data

May 19, 2022 (CZ) ..... CZ2022-208

(51) Int. Cl.
*F41A 21/48* (2006.01)

(52) U.S. Cl.
CPC ..... *F41A 21/487* (2013.01); *F41A 21/484* (2013.01); *F41A 21/485* (2013.01)

(58) Field of Classification Search
CPC ..... F41A 21/484; F41A 21/487
See application file for complete search history.

(56) References Cited

U.S. PATENT DOCUMENTS 1,165,976 A * 12/1915 Johnson ..... F41A 21/482 42/75.01
1,191,515 A * 7/1916 Johnson ..... F41A 21/482 42/75.02

(Continued)

FOREIGN PATENT DOCUMENTS

DE 2011002607 U1 5/2012

OTHER PUBLICATIONS

PCT Search Report and Written Opinion dated Jul. 5, 2023 for related PCT Patent Application No. PCT/CZ2023/000016, 7 pages.

*Primary Examiner* — Derrick R Morgan
(74) *Attorney, Agent, or Firm* — Hovey Williams LLP; Paul J. Walker

(57) ABSTRACT

An assembly of a receiver (1) with a barrel (4) wherein the barrel (4) is inserted into a barrel hole (7) in the receiver (1) and is attached in a replaceable manner by means of a clamping connection that comprises a longitudinal slot (2) that longitudinally divides the receiver (1) wall in the insertion location of the barrel (4). In the location of the longitudinal slot (2) at least two transversal screws (3) pass through the receiver (1). In the location of the longitudinal slot (2), a transversal hole (5) extends into the receiver (1) and a transversal pin (10) passes through the transversal hole (5) in such a way that the transversal pin (10) reaches into a corresponding transversal recess (9) in the barrel (4). Perpendicularly to the longitudinal axis of the transversal pin (10) a threaded hole (11) with a connecting screw (12) passes through the transversal pin (10). The connecting screw (12) further passes through a straight-through hole (6) in the receiver (1) and through a stock/frame (13) of the firearm to connect the receiver (1) to the stock/frame (13) of the firearm.

6 Claims, 3 Drawing Sheets

(56) References Cited

U.S. PATENT DOCUMENTS

| | | | | | |
|---|---|---|---|---|---|
| 1,370,118 | A * | 3/1921 | Johnson | F41A 21/484 | 24/2.5 |
| 2,371,282 | A * | 3/1945 | Clarkson | F41C 23/02 | 42/75.01 |
| 2,437,137 | A * | 3/1948 | Swebilius | F41A 21/484 | 42/75.02 |
| 3,075,313 | A * | 1/1963 | Allyn | F41C 7/02 | 89/187.01 |
| 3,183,617 | A * | 5/1965 | Ruger | F41A 21/484 | 42/25 |
| 3,731,418 | A * | 5/1973 | Birkenhagen | F41A 21/487 | 42/75.02 |
| 5,540,008 | A | 7/1996 | Kirnstaetter | | |
| 6,634,128 | B1 * | 10/2003 | Vastag | F41A 21/484 | 42/59 |
| 2013/0219765 | A1 * | 8/2013 | Ibarguren | F41A 21/485 | 42/75.02 |
| 2018/0080733 | A1 * | 3/2018 | Battaglia | F41A 21/484 | |
| 2019/0226789 | A1 * | 7/2019 | Battaglia | F41A 21/484 | |
| 2020/0318928 | A1 * | 10/2020 | Downey | F41A 21/484 | |

* cited by examiner

ASSEMBLY OF A RECEIVER WITH A BARREL

RELATED APPLICATIONS

This application is the National Stage of International Patent Application No. PCT/CZ2023/000016, filed Apr. 20, 2023, which is hereby incorporated herein by reference in its entirety, and which claims priority to Czech Patent Application No. PV 2022-208, filed May 19, 2022, which is also incorporated herein by reference in its entirety.

TECHNICAL FIELD

The invention relates to an assembly of a receiver with a barrel, the barrel being inserted into a barrel hole in the receiver and being attached in a replaceable manner by means of a clamping connection that comprises a longitudinal slot that longitudinally divides the wall of the receiver in the insertion location of the barrel, and at least two transversal screws passing through the receiver in the location of the longitudinal slot, and a transversal hole extending into the receiver in the location of the longitudinal slot, and a transversal pin passing through the transversal hole in such a way that the transversal pins reaches into a corresponding transversal recess in the barrel.

BACKGROUND ART

In non-modular firearms, i.e., without the possibility of replacing the barrel on the user level, the barrel is often directly screwed into the receiver. The barrel may also be connected to the receiver by pressing, or with the use of a pin.

Concerning modular firearms, their barrel can either be replaced without the use of tools or with the use of a minimal number of tools, preferably a single tool.

Firearms wherein the barrel can be removed without the use of tools are also called "take-down" firearms and have various barrel fixing mechanisms. Various lever cogs that are controlled from the outside or bayonet mechanisms are used. However, these types of firearms are not designed for easy replacement of the barrel. They provide the possibility of disassembling the firearm, mostly into two subgroups (barrel, the rest) to dramatically reduce the length, e.g., for transport.

In firearms where the barrel can be removed with the use of tools, these tools may be stored inside the gun, or are supplied together with the firearm as accessories. This type of firearms is not primarily intended for disassembly of the firearm for storage or transport, but their design does not make this impossible.

A known design of a firearm where the barrel can be removed using a tool features a barrel inserted into the receiver and attached in a replaceable manner using a clamping connection that comprises a longitudinal slot that longitudinally divides the wall of the receiver in the barrel insertion location having a slightly bigger length that the length of insertion of the barrel into the receiver. In the location of the longitudinal slot, at least two transversal screws pass through the receiver. Such a clamping connection then clamps to receiver in the region of the slot to fix the barrel.

Such a connection is very firm and stable and does not affect accuracy. In addition, it is relatively easy to produce, and thus cheap.

A disadvantage of such a design is that it makes it possible to mount the barrel in a different position or to leave the transversal screws poorly tightened. This may result in a slight extension/rotation of the barrel and consequently endangering of the shooter.

In the design according to the application US2013/0219765A1, the head of a screw reaches into a recess in the barrel. However, this design does not deal with the connection of the receiver and barrel with the frame, or the stock. In practice this means that the shooter's safety is only guaranteed in case the screws of the clamping connection are insufficiently or wrongly tightened. But this design does not cover the case these screws are completely missing in the firearm due to the human factor. In such a case, the forestock can be quite normally screwed onto the firearm, but the barrel will not be safely attached/fixed.

The object of the invention is to propose such an improvement of a known assembly of the receiver with the barrel that will not have the above-mentioned shortcomings of the prior art.

SUMMARY OF THE INVENTION

The said goal is achieved through an assembly of a receiver with a barrel wherein the barrel is inserted into a barrel hole in the receiver and is attached in a replaceable manner by means of a clamping connection that comprises a longitudinal slot, that longitudinally divides the wall of the receiver in the barrel insertion location, and in the location of the longitudinal slot, at least two transversal screws pass through the receiver, and in the location of the longitudinal slot, a transversal hole extends into the receiver and a transversal pin passes through the transversal hole in such a way that the transversal pin reaches into a corresponding transversal recess in the barrel, according to the invention the principle of which is that a threaded hole with a connecting screw passes through the transversal pin perpendicularly to the longitudinal axis of the transversal pin wherein the connecting screw further passes through a straight-through hole in the receiver and through the stock/frame of the firearm to connect the receiver to the stock/frame of the firearm.

An advantage of the assembly according to the invention is that the threaded hole passing through the transversal pin perpendicularly to the longitudinal axis of the transversal pin with the connecting screw screwed in, which further passes through the straight-through hole in the receiver and through the stock/frame of the firearm, will eliminate the risk of inadvertent release of the barrel even in case the transversal screws in the receiver are completely absent due to the human factor. All this even if the user forgets to insert the transversal pin into the receiver because this will make the connection with the stock/frame of the firearm impossible and the user will immediately notice that the firearm is not properly assembled.

This is mainly important in modular rifles where the user can replace barrels of the firearm by him-/herself. The solution according to the invention provides the user with safety in case of any wrong replacement of the barrel.

In preferred embodiments, the transversal pin may have both a circular cross-section, and a non-circular cross-section.

In a preferred embodiment, the transversal hole comprises of a blind hole.

In another preferred embodiment, a spring-loaded catch protrudes from the surface of the transversal pin to snap into the corresponding recess in the receiver.

In still another preferred embodiment, a guiding groove is provided in the transversal pin surface that a stop attached to the stock/frame of the firearm extends into.

BRIEF DESCRIPTION OF DRAWINGS

The invention will be described in a more detailed way with reference to particular embodiment examples of the assembly of the receiver with the barrel according to the invention, represented in the attached drawings where individual figures show.

EXAMPLES OF EMBODIMENTS

Figure 1:
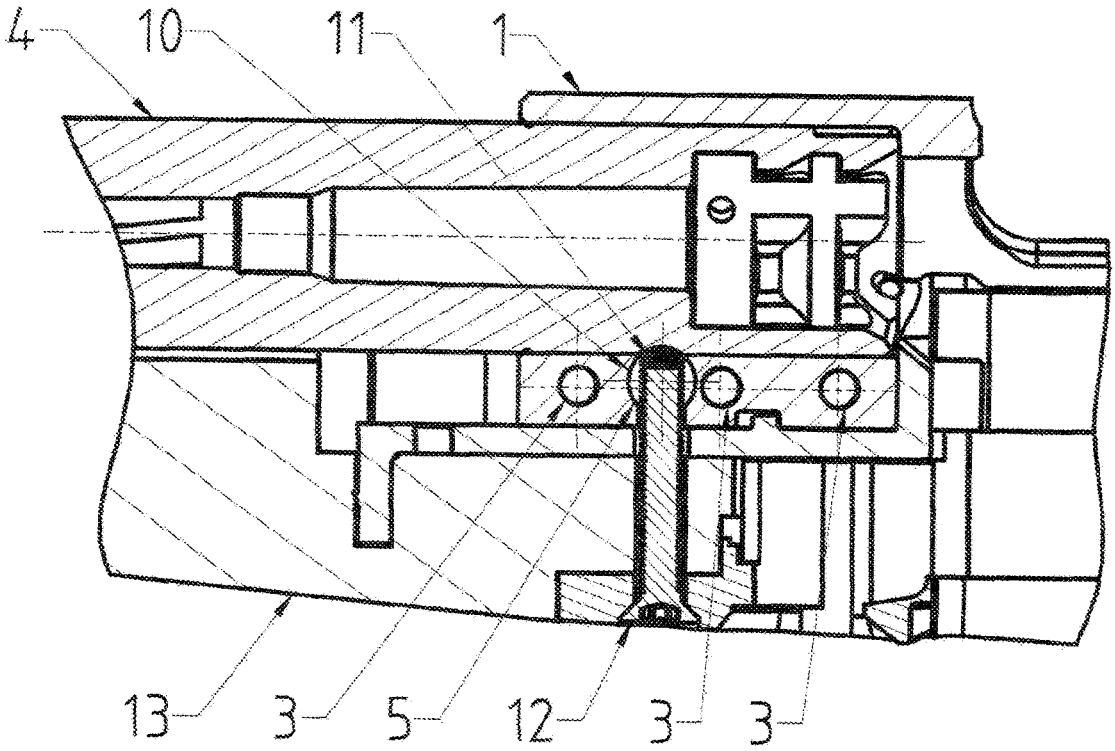
FIG. 1—vertical longitudinal section of the assembly of the receiver with the barrel according to the invention, attached to the firearm stock.
Figure 2:
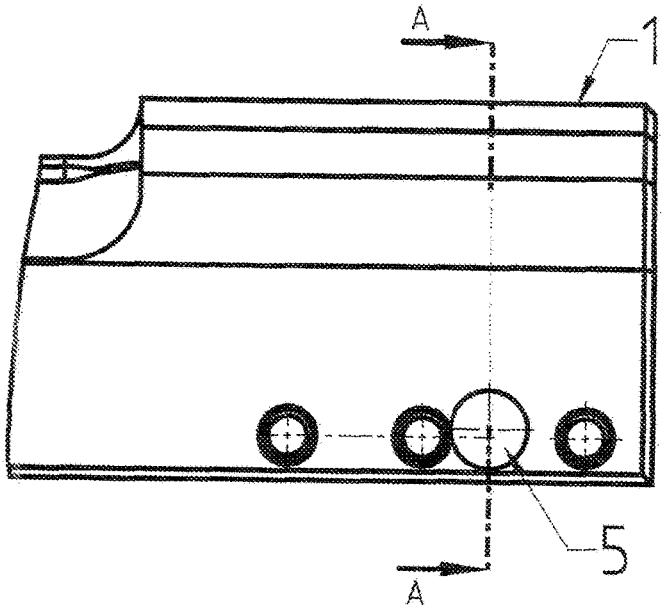
FIG. 2—view of the receiver from the right side.

The assembly of the receiver 1 with the barrel 4 is shown as attached to the stock 13 of a long firearm in FIG. 1.

The barrel 4 is inserted into the barrel hole 7 in the receiver 1 and is attached in a replaceable manner by means of a clamping connection that comprises of a longitudinal slot 2 that longitudinally divides the wall of the receiver 1 in the Insertion location of the barrel 4. The clamping connection further comprises of three transversal screws 3 that pass through the receiver 1 in the location of the longitudinal slot 2.

Figure 3:
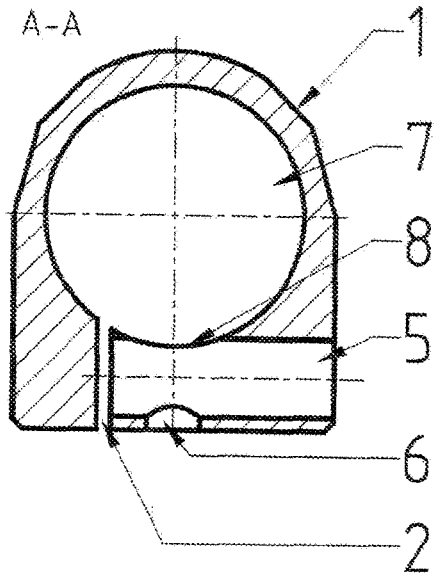
FIG. 3—vertical cross-section of the receiver.
Figure 4:
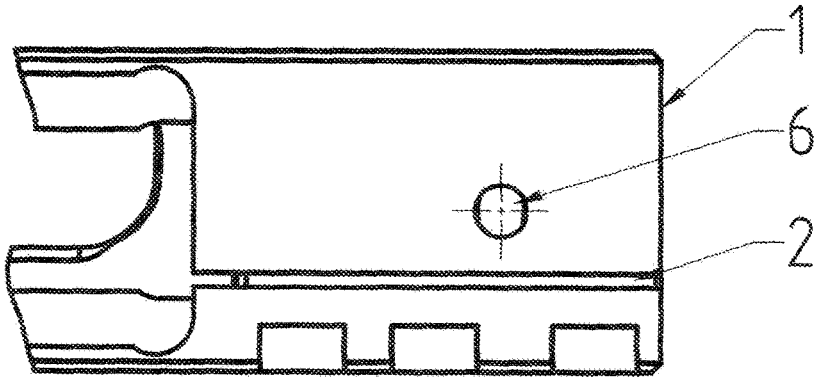
FIG. 4—bottom view of the receiver.
Figure 5:
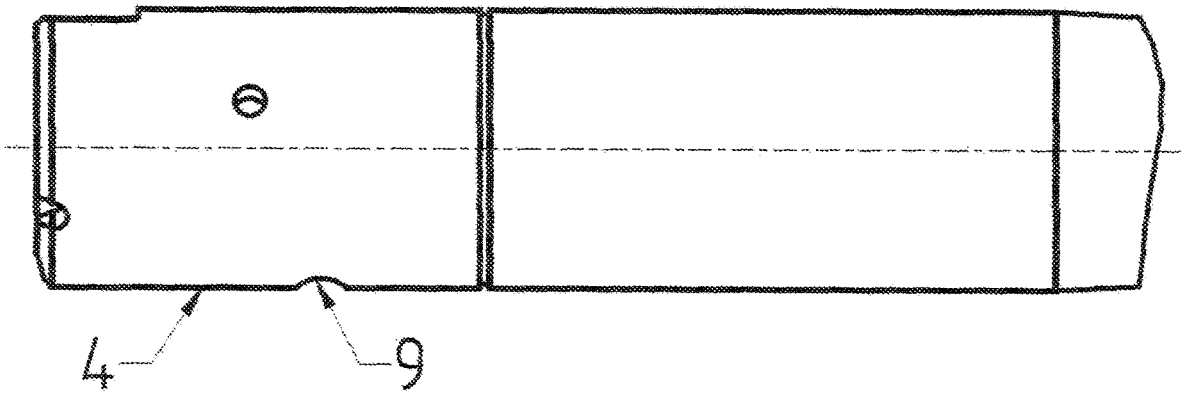
FIG. 5—view of the barrel from the right side.
Figure 6:
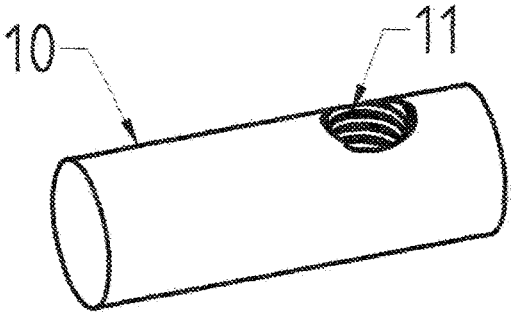
FIG. 6—axonometric view of the transversal pin.

In the location of the longitudinal slot 2, a transversal hole 5 extends into the receiver 1, the transversal hole being a blind hole and ending in the location of the slot 2 in the displayed example (see FIG. 3). A transversal pin 10 passes through the transversal hole 5 in such a way that the transversal pin 10 reaches into the corresponding transversal recess 9 in the barrel 4.

In FIG. 3, an intersection 8 of the transversal hole 5 and the opening 7 for the barrel 4 in the receiver 1 is perceivable.

A threaded hole 11 passes through the transversal pin 10 perpendicularly to the longitudinal axis of the transversal pin 10 (see FIGS. 1 a 6), a connecting screw 12 being screwed into the threaded hole, passing at the same time through the straight-through hole 6 in the receiver 1 and through the stock/frame 13 of the firearm to connect the receiver 1 to the stock/frame 13 of the firearm (see FIG. 1).

The fact whether the receiver 1 is connected to the stock 13 or frame 13 of the firearm depends on whether the assembly according to the invention is applied to a long or short firearm.

In the embodiment examples shown, the transversal pin 10 has a circular cross section, but skilled persons will appreciate that the transversal pin 10 may also have a non-circular cross-section, e.g., a rectangular one.

Figure 7:
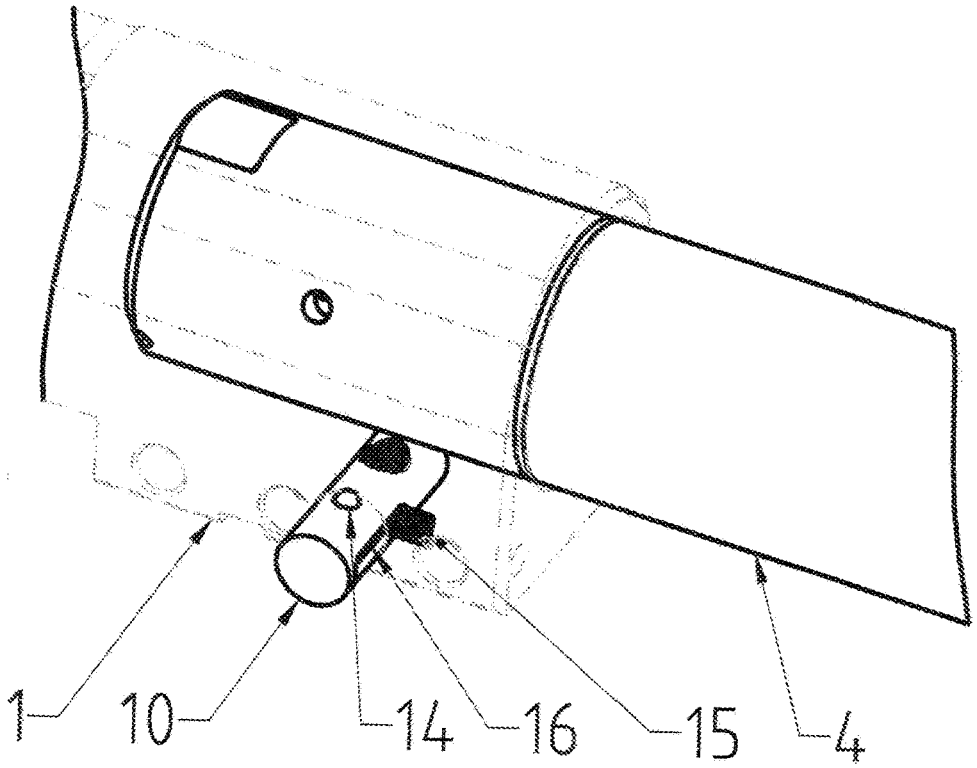
FIG. 7—an embodiment example with a transversal pin fitted with a spring-loaded catch and a guiding groove with a stop wherein the transversal pin is completely withdrawn.
Figure 8:
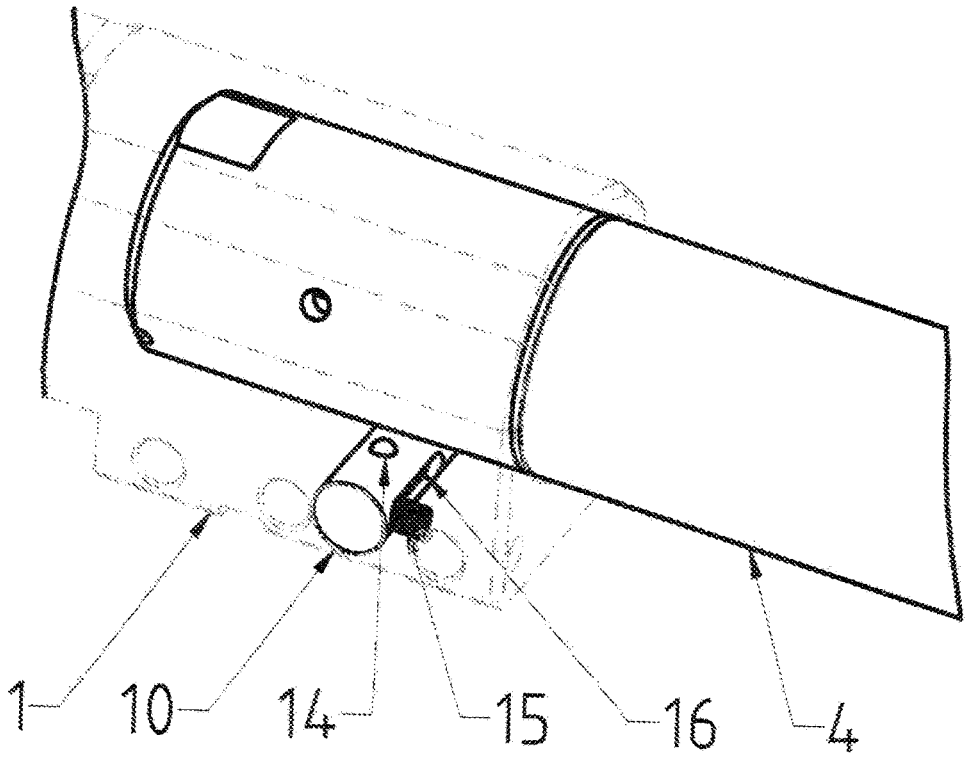
FIG. 8—the embodiment of FIG. 7 wherein the transversal pin is completely inserted.

FIGS. 7 and 8 show another embodiment example of the assembly according to the invention where a spring-loaded catch 14 protrudes from the surface of the transversal pin 10 to snap into a corresponding recess in the receiver 1. The spring-loaded catch 14 is a ball that is pushed by a not shown spring in such a way that it partly protrudes over the surface of the transversal pin 10. During the insertion of the transversal pin 10 into the transversal hole 5, the ball is first pushed into the transversal pin 10 against the spring pressure, and subsequently it snaps into a recess in the receiver 1, which is not shown here.

The end positions of the inserted and withdrawn transversal pin 10 are delimited by a stop 15 that is fixed in the stock 13 of the firearm and extends into the guiding groove 16 that is created in the transversal pin 10.

During the replacement of the barrel 4, both to change the calibre, or just to replace a worn barrel 4, no intervention of a specialist gunmaker is necessary.

All that the user needs to do is to release the transversal screws 3 and withdraw the transversal pin 10 so that it should not extend into the transversal recess 9 in the barrel 4, which will cause releasing of the barrel, so the barrel 4 will get free and it can be freely withdrawn from the opening 7 in the receiver 1. After inserting of the new barrel 4, this barrel 4 will then be fixed in an analogous manner.

LIST OF REFERENCE SIGNS

1 receiver
2 slot
3 transversal screw
4 barrel
5 transversal hole
6 straight-through hole
7 barrel hole
8 intersection of the transversal hole and the barrel hole
9 transversal recess
10 transversal pin
11 threaded hole
12 connecting screw
13 stock/frame of the firearm
14 spring-loaded catch
15 stop
16 guiding groove

The invention claimed is:

1. An assembly of a receiver with a barrel, wherein the barrel is inserted into a barrel hole in the receiver and the barrel is attached in a replaceable manner by a clamping connection that comprises a longitudinal slot that longitudinally divides the receiver wall at the insertion location of the barrel and at least two transverse screws configured to pass through the receiver at the longitudinal slot, and a transverse hole extends into the receiver at the longitudinal slot and a transverse pin passes through the transverse hole in such a way that the transverse pin is received in a corresponding transverse recess in the barrel, the transverse pin having a threaded hole extending perpendicular to the longitudinal axis of the transverse pin and a connecting screw received in the threaded hole, wherein the connecting screw further passes through a straight-through hole in the receiver and through a stock/frame of the firearm to connect the receiver to the stock/frame of the firearm.

2. The assembly according to claim 1, characterized in that the transverse pin has a circular cross-section.

3. The assembly according to claim 2, characterized in that the transverse pin has a non-circular cross-section.

4. The assembly according to claim 1, characterized in that the transverse hole comprises a blind hole.

5. The assembly according to claim 1, characterized in that a spring-loaded catch protrudes from the surface of the transverse pin to snap into a corresponding recess in the receiver.

6. The assembly according to claim 1, characterized in that, in the surface of the transverse pin, a guiding groove is created, a stop that is attached to the stock/frame of the firearm is received into the guiding groove.

* * * * *